US006313861B2

(12) United States Patent
Schartner

(10) Patent No.: US 6,313,861 B2
(45) Date of Patent: Nov. 6, 2001

(54) THERMAL TRANSFER PRINTER WITH PRINT FILM SAVING SYSTEM AND PRINT MEDIA TENSIONING SYSTEM

(75) Inventor: Zachery J. Schartner, Narragansett, RI (US)

(73) Assignee: Astro-Med, Inc., West Warwick, RI (US)

( * ) Notice: Subject to any disclaimer, the term of this patent is extended or adjusted under 35 U.S.C. 154(b) by 0 days.

(21) Appl. No.: 09/733,802

(22) Filed: Dec. 9, 2000

Related U.S. Application Data

(63) Continuation-in-part of application No. 09/514,799, filed on Feb. 29, 2000, which is a continuation of application No. 09/300,067, filed on Apr. 27, 1999, now Pat. No. 6,031,555.

(51) Int. Cl.[7] ..... B41J 15/16
(52) U.S. Cl. ..... 347/219; 400/618
(58) Field of Search ..... 347/219, 215, 347/218; 400/611, 613, 614, 617, 618; 226/195, 38; 242/419

(56) References Cited

U.S. PATENT DOCUMENTS 5,675,369 * 10/1997 Gaskill ..... 347/173
5,859,656 * 1/1999 Aragon et al. ..... 347/219

* cited by examiner

*Primary Examiner*—Huan Tran
(74) *Attorney, Agent, or Firm*—Barlow, Josephs & Holmes

(57) ABSTRACT

A thermal transfer printing device, i.e. thermal printer, includes a printing film saving system wherein the print head is lifted during media advancement so that the print film is not advanced during media advancement, and further includes an associated arrangement for tensioning of the print media during printing and print head lifting operations so that the print media maintains print registration and the printing film does not pull upwardly when the print head is lifted. Single print station (monochrome) and multiple print station (color) embodiments are disclosed. Forward tensioning is accomplished by the use of a feed drive positioned forwardly of the single print station in the monochrome embodiment, or forwardly of the last print station in the color embodiment. The feed drive comprises a nip that pulls the print media through the print stations. In the color embodiment, rearward tensioning is accomplished by the print media supply roll, or further upstream by adjacent print stations. In the monochrome embodiment, rearward tensioning is accomplished by a second rearward feed drive that is operable for retracting the print media back into the printer after forward advancement thereof.

6 Claims, 10 Drawing Sheets

300
308
MOTOR
312
CONTROLLER
MOTOR
310
328
340
320
330
372
360
324
368
326
352
364
344
346
322
348
354
334
366
374
362
342
370
350
328

THERMAL TRANSFER PRINTER WITH PRINT FILM SAVING SYSTEM AND PRINT MEDIA TENSIONING SYSTEM

RELATED APPLICATION DATA

This application is a continuation in part of U.S. application Ser. No. 09/514,799 filed Feb. 29, 2000, currently pending, which is a continuation of U.S. application Ser. No. 09/300,067 filed Apr. 27, 1999, now U.S. Pat. No. 6,031, 555.

BACKGROUND OF THE INVENTION

The instant invention relates generally to thermal printing devices and more particularly to a thermal label printing device having a printing film saving system wherein the print head is lifted during media advancement so that the print film is not advanced during media advancement, and an associated arrangement for tensioning of the print media during printing and print head lifting operations so that the printing film does not pull upwardly when the print head is lifted.

Currently available thermal transfer printing heads generally comprise a plurality of thermal elements. The heating elements are generally provided on one side of a flat substrate of ceramic or like material along with the requisite electronic circuitry for controlling the activation of the heating elements.

The thermal transfer printing head is typically used in conjunction with a roller platen assembly and ink transfer printing film or ribbon, which carries a thermally transferable printing ink. During printing, a web of material to be printed is oriented between the thermal elements of the printing head and the roller platen of the roller platen assembly such that the printing ribbon is adjacent to the print head and the material to be printed is adjacent to the roller platen. The roller platen and printing head are moved against each other so that the printing ribbon and the material to be printed are pressed against the printing head such that when selected thermal elements of the printing head are heated, ink from the ink transfer printing ribbon is transferred to the surface of the material.

Thermal transfer printers such as these are often used to print adhesive labels wherein the adhesive labels are serially mounted on a continuous web. These label printers typically have a single drive means located downstream of the print head for drawing or pulling the web from the web supply through the print head. As the web is advanced or pulled through the printing device, the heating elements of the print head are selectively energized so that the print head is only selectively operative for printing on the adhesive label portion of the web rather than on the intermediate portions of the web backing. The labels are printed serially as they pass through the print head and are advanced out of the printer wherein they are either wound on a spool for later use or presented for use by an operator. Such label printers have found widespread acceptance in industries wherein a plurality of adhesive labels is printed identically.

However, in other industries where it is desired to repeatedly change the printing on the labels, such as for example in the individual printing of shipping labels, there are drawbacks to using the same type of continuous printing as for the identical label. The primary problem relates to the use of a continuous web with serial labels, the position of the just printed label with regard to the print head immediately after printing, and the proximity of the exit opening in relation to the print head and the drive assembly. Because the labels are serially mounted on the carrier web, the freshly printed label is still positioned near to the print head after printing, and is still within the drive means. While the exit end of the print head is adjacent to the exit opening in the device, the entire label or a portion of this just printed label is still not immediately accessible to the operator for removal from the web. In this case, the first printed label cannot be removed for use until several additional labels have been printed and have thus advanced the first label outwardly far enough to be accessible. Serially printing labels in this manner and allowing several labels to be backed up within the printer can cause errors in matching the labels with packages or other goods upon which the labels are to be placed.

Accordingly, there is a need for a label printer that can effectively function under both scenarios, i.e. serially printing a plurality of identical labels, or individually printing labels one at a time.

SUMMARY OF THE INVENTION

In this regard, the instant invention provides a solution to the above-noted need. The instant invention solves the noted problems by providing two improved mechanisms in the printing engine. The first improvement comprises the provision of a print head lifting mechanism, wherein the print head is lifted away from the print media during operation. Print head lifting mechanisms have also been used in the past for single station thermal color print engines wherein a single print head is used to print in color on the print media. The print head lifting mechanism provides two significant functional advantages in this arrangement. The first advantage is in allowing the print media to be quickly advanced and retracted without being held by the print head. In this manner, after an individual label is printed, the print head can be lifted, and the label advanced out of the printer for removal. The print media can then be retracted for printing of the next label. The second advantage is in print film saving. By lifting the print head out of engagement with the print media during media advancement, the apparatus does not draw print film during periods when no printing occurs, i.e. while the print head is lifted. The second improvement comprises the use of a print media tensioning system to maintain tension of the print media during operation. Lifting of the print head from the print media permits the print media to move during advancement and retraction and often can cause mis-registration when the print head is lowered back into engagement with the print media. In addition, because thermal printing involves the heated transfer of printing ink from the film to the media, the printing film can sometimes stick to the print media. Lifting of the print head from the print media can thus pull the print media upwardly with the printing film and further cause registration problems and smudging of the ink.

The print media tensioning system generally comprises the use of two tensioning devices, a first device located upstream of the print head and a second device located downstream of the print head. The use of upstream and downstream tensioning device serves to effectively holds the print media taught at both ends even when the print head is not in engagement with the platen.

More specifically, a continuous web of labels comprises a plurality of adhesive backed labels serially mounted on a continuous backing web from which the labels can be removed during operation. The thermal transfer printer comprises a supply roll for carrying a supply of the continuous web of labels and a take up roll for taking up the backing web as the labels are printed and removed from the backing web. The supply roll includes a back tensioning clutch for tensioning removal of the web from the supply.

In a first embodiment, a color print engine comprises four serial print heads, each of which print a single color, i.e. cyan, magenta, yellow and black, as the labels advance through the printer. This arrangement would typically be used to serially print a plurality of identical labels. Each printing mechanism includes a platen and a thermal print head mounted for biased engagement with the platen. The backing web passes intermediate the thermal print head and the platen. In addition, a thermal printing film passes intermediate the backing web and the thermal print head. Each printing mechanism includes a print head lifting mechanism that is selectively engageable with the print head for moving the print head between a first position wherein the print head—is biased into engagement with the platen, and a second position wherein the print head is lifted out of engagement with the platen. Movement of the web through the apparatus is accomplished by a nip or feed drive positioned forwardly of the printing mechanism for pulling the continuous web forwardly through the printing mechanism when the print heads are in the engaged position. Images are printed on the labels during this forward movement of the web. In this first embodiment, each pair of nip points serves to function as the tensioning mechanism. For example, the print media at the first print station is tensioned by the back tension of the supply roll and the printing nip at the second print station. Likewise, the print media at the second print station is tensioned by the print nips at the first and third print stations. The print media at the fourth and final print station is tensioned by the drive nip and the printing nip of the third printing station. In a second embodiment, a monochrome print engine that can be used to serially print individual labels, the print engine comprises a single print head that uses a single color printing film, usually black. The feed drive pulls the print media through the print head for printing thereof, and is further operative for advancing the continuous web forwardly when the print head is in the up position so that the just printed label is immediately presented for removal from the backing web. The second embodiment further includes a second drive positioned rearwardly (upstream) of the printing mechanism for pulling the continuous web rearwardly through the printing mechanism when the print head is in the second position whereby a next serially mounted label is positioned for printing in the printing mechanism. In this embodiment, the first and second feed drives cooperate to maintain the continuous web in a taught printing position during forward and rearward movement thereof. The first and second drives each comprise a drive roller and a pressure roller, each roller being rotatably mounted for capturing the web in a nip relation and for driving the web. To allow reverse movement of the web through each of the drives, each of the drive rollers is mounted with a one-way clutch to allow reverse rotation thereof. The one-way clutch on the drive roller of the first web drive allows frictional rotation in a counterclockwise direction, while the one-way clutch on the drive roller of the second web drive allows frictional rotation thereof in a clockwise direction.

Accordingly, among the objects of the instant invention are:

the provision of a print head lifting mechanism for lifting the print head during operation of the print engine;

the provision of a print head lifting mechanism which is functional for saving printing film during periods of non-printing;

the provision of a print head lifting mechanism which is functional for allowing the print media to be advanced for individual printing of serially mounted labels on a web;

the provision of a print media tensioning system that maintains the print media in a taught condition to maintain print registration and to help separate the printing film from the print media during lifting of the print head from the print media;

the provision of a thermal transfer label printer having a first drive for advancing the print web for printing and accessing the printed label, and a second drive for retracting the print web for printing of the next label; and the provision of a monochrome thermal transfer printer having a dual drive assembly wherein the drives are located on opposing sides of the print head to maintain the print web taught through the print head.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE PREFERRED EMBODIMENTS

Figure 1:
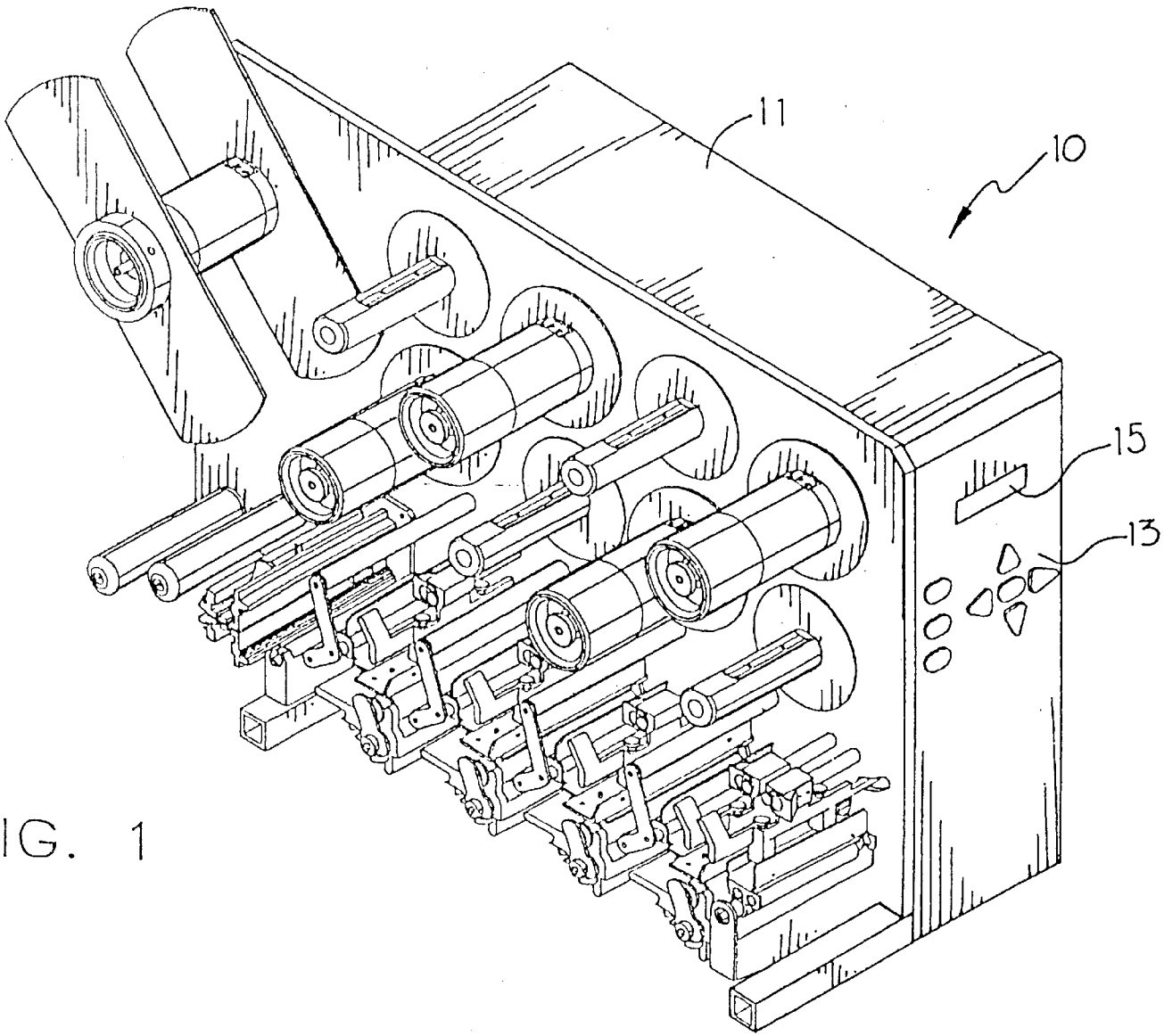
FIG. 1 is a perspective view of the printing apparatus of the present invention.
Figure 2:
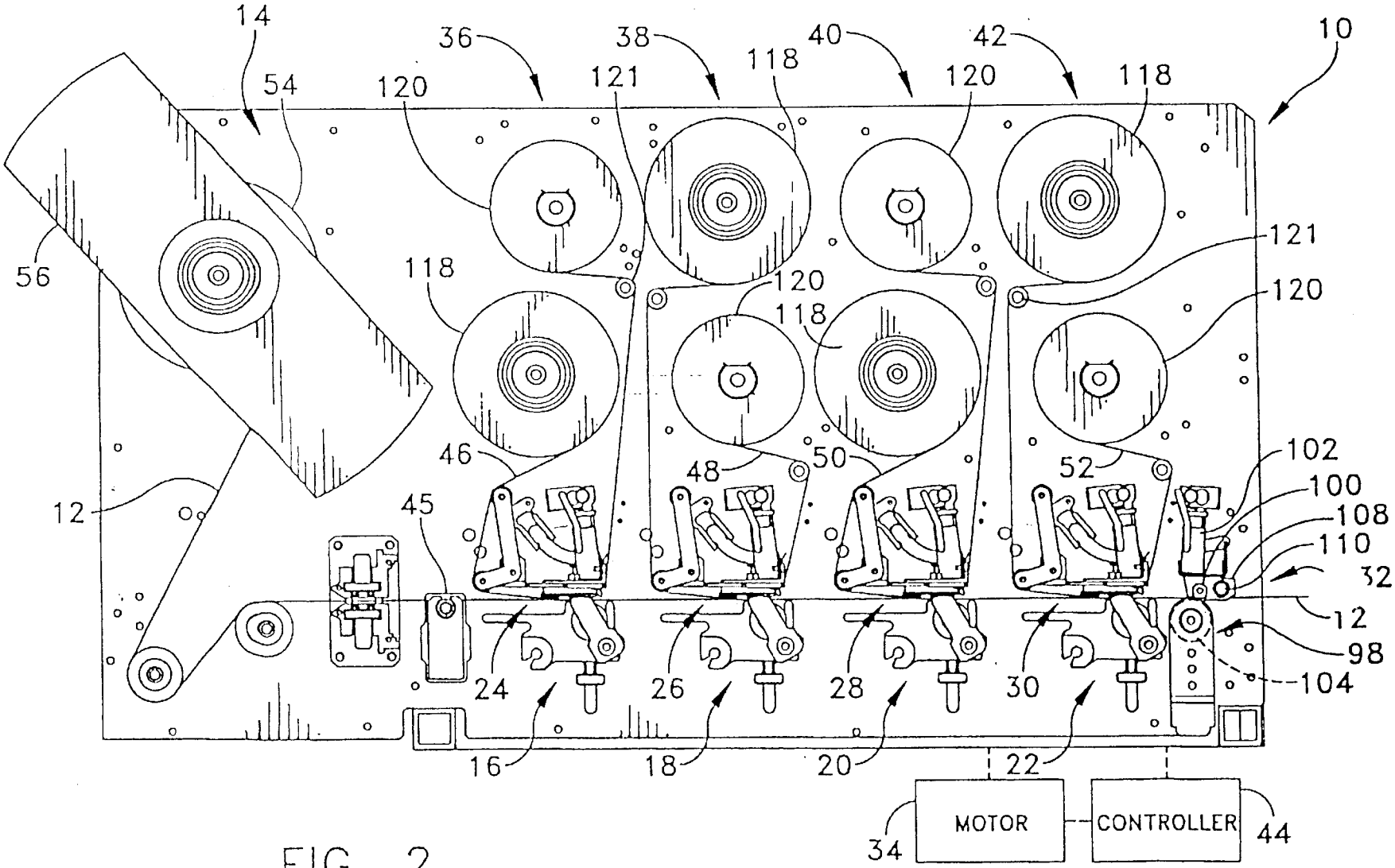
FIG. 2 is a front view of the printing apparatus of the present invention, showing the four printing assemblies in the actuated position.
Figure 3:
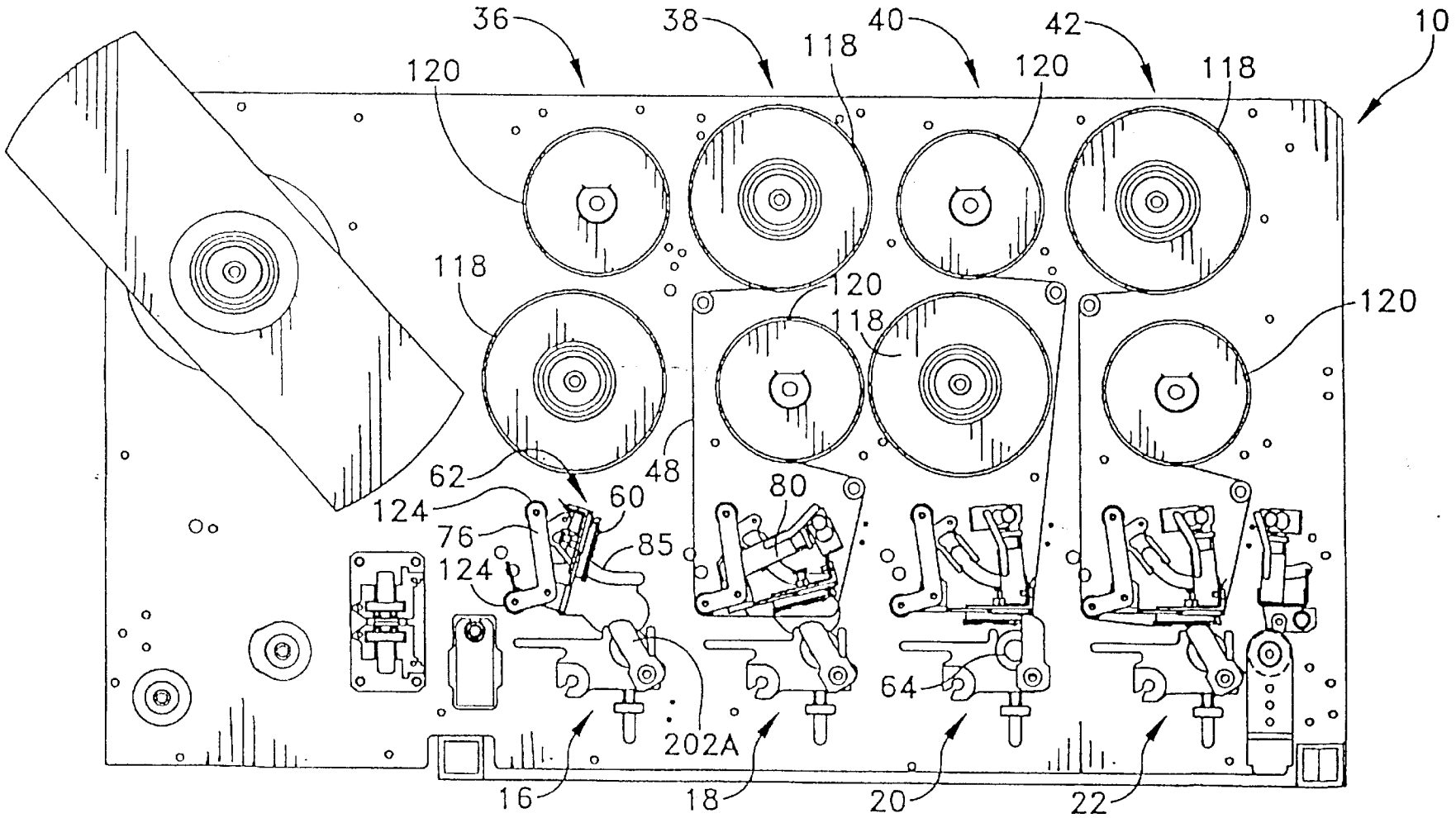
FIG. 3 is a front view of the printing apparatus of the present invention, showing each of the four printing assemblies in a different position.

Referring now to the drawings, there is generally indicated at 10 in FIGS. 1–3, a printing device that embodies the printing assembly of the present invention. The printing assembly is shown removed from the printing device 10 in FIGS. 4–7. FIG. 1 is a perspective view of a printing device 10, which is capable of respectively printing multiple colors on printed articles that are serially connected together or mounted on a carrier media web 12. For simplicity, the printed articles on which the present invention will be described as printing are adhesive labels that are serially mounted on a web 12. However, it will be understood that any type of suitable article may be printed using the printing apparatus of the present invention.

Printing device 10 includes a housing 11 for enclosing certain mechanical devices associated with the device 10, including a stepping motor 34 and a controller 44 (both shown schematically in FIG. 2) for controlling the operation of the printing device 10. The controller 44 includes electronics known in the art and therefore, they will not be described. Housing 11 includes a control panel including a number of control buttons 13 for programming and controlling the printing device 10, as well as a display unit 15 for indicating an operation mode and/or status of the printing device 10.

The apparatus 10 includes a back plate generally indicated at 14, first, second, third and fourth printing assemblies generally indicated at 16, 18, 20 and 22, respectively, operable at first, second, third and fourth printing stations 24, 26, 28 and 30 for printing first, second, third and fourth colors onto each label of the web 12. Apparatus 10 also includes a feed assembly generally indicated at 32 for drawing the web 12 through the printing stations.

The apparatus 10 further includes first, second third and fourth printing film drive assemblies generally indicated at 36, 38, 40 and 42. During the operation of the apparatus 10, the printing film drive assemblies 36, 38, 40 and 42 are operated to supply first, second, third and fourth printing films 46, 48, 50 and 52 respectively, to the printing stations 24, 26, 28 and 30 and the stepping motor 34 is operated to advance the strip 12 in a substantially taut disposition between the printing stations. The controller 44 is responsive to a predetermined number of increments of an encoder 45, which tracks the position and speed of the labels on the web 12, for controlling the printing assemblies 16, 18, 20 and 22 to apply images of different colors to the labels mounted on web 12 so that the longitudinal positions of the images are precisely coordinated throughout the length of each label. Encoder 45 is of conventional design and therefore, its operation will not be described.

The web 12, as described above, preferably comprises a continuous strip of a plastic or paper-like substrate having a width of approximately 1 to 5 inches with a number of adhesive-backed labels (not shown) serially mounted thereon. While, in this description, the labels preferably have an adhesive backing for mounting to the web and then to a product after printing, it will be understood that the labels may be mounted to the web by any known means such as, for example, static electricity. The web 12 is preferably provided in a continuous roll 54 that is mounted on payoff roller 56 mounted to the back plate 14. The payoff roller 56 includes a back-tension clutch to prevent print media slack.

Figure 5:
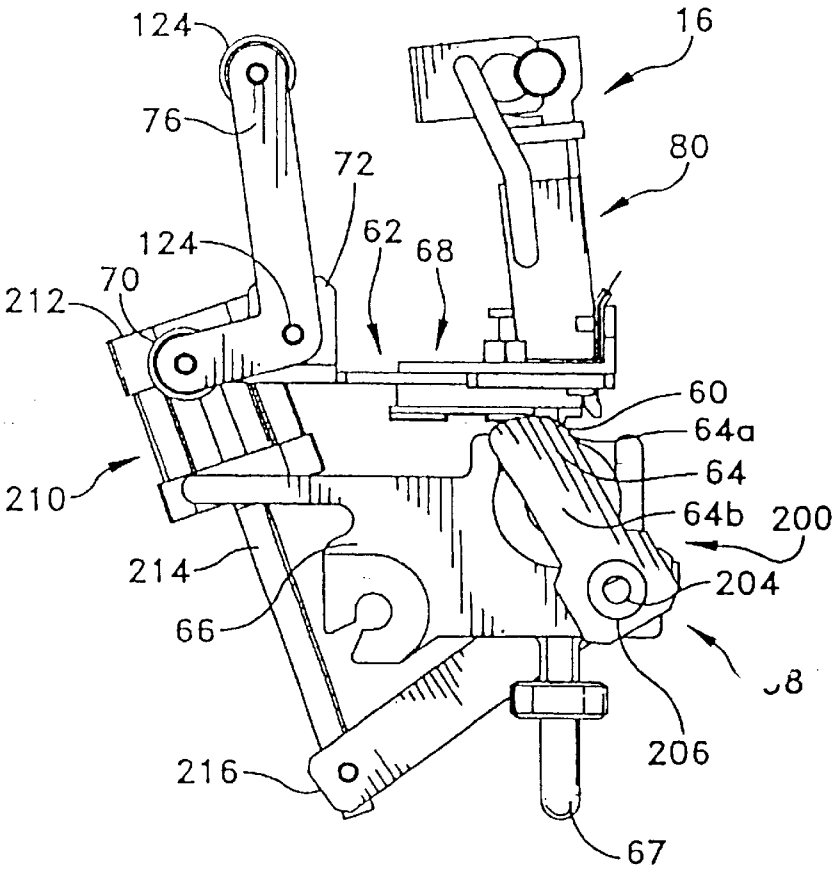
FIG. 5 is a front view of one printing assembly of the present invention, showing the head being biasedly engaged with the platen.
Figure 4:
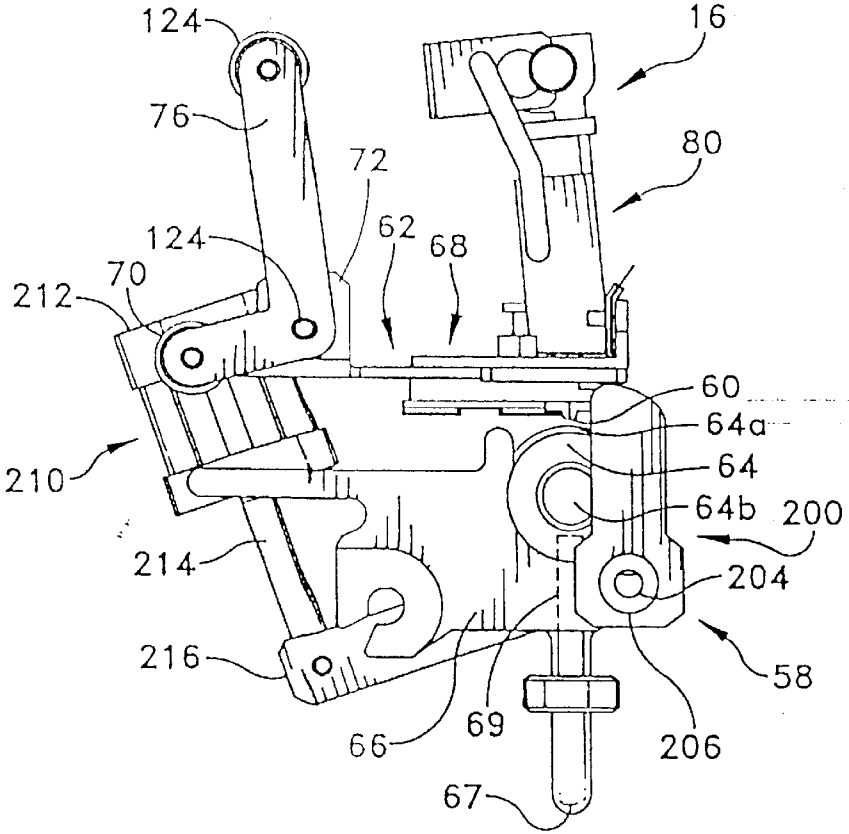
FIG. 4 is a front view of one printing assembly of the present invention, showing the head being lifted out of engagement with the platen.
Figure 6:
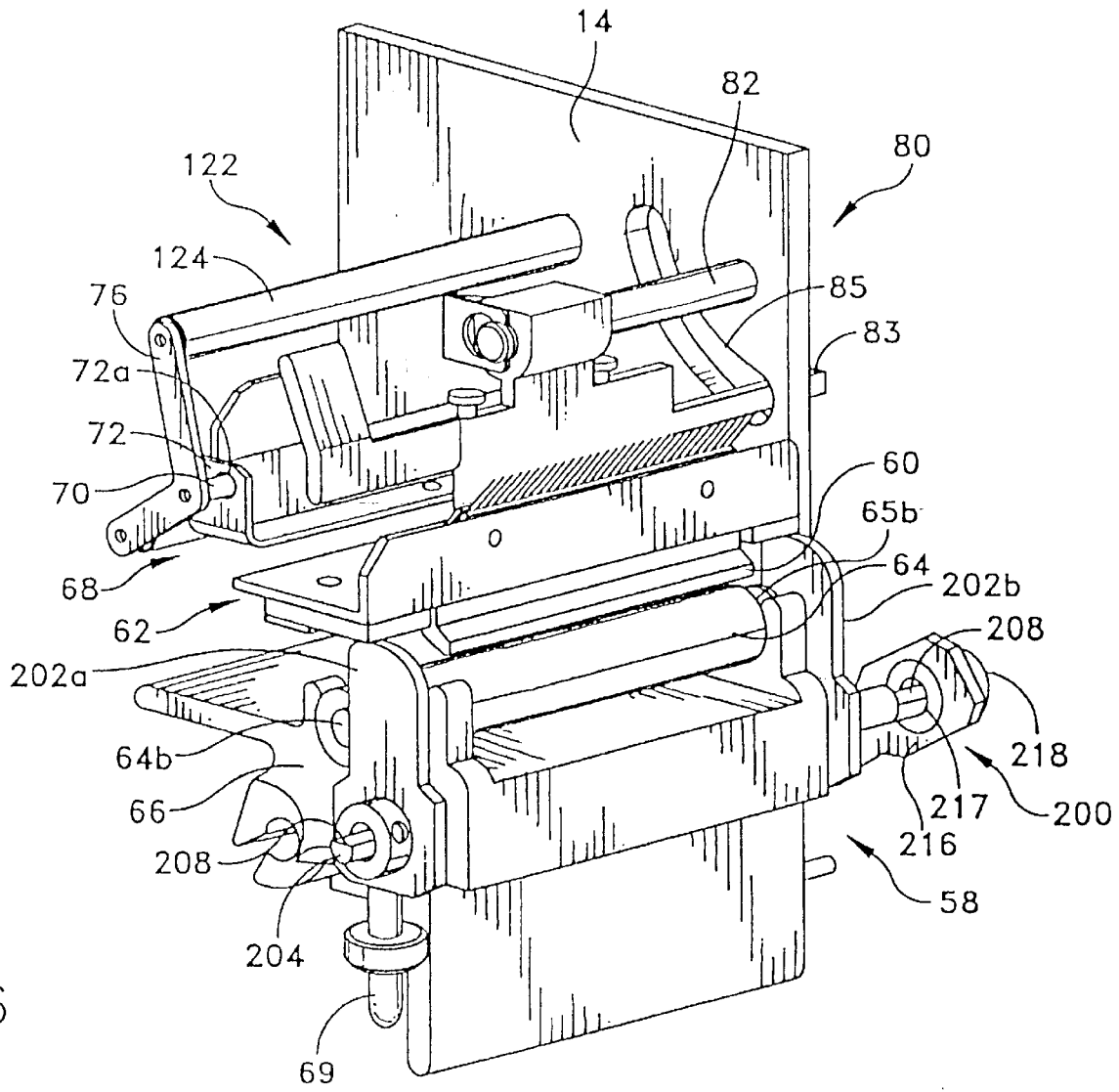
FIG. 6 is a front perspective view of one printing assembly of the present invention, showing the head being lifted out of engagement with the platen.
Figure 7:
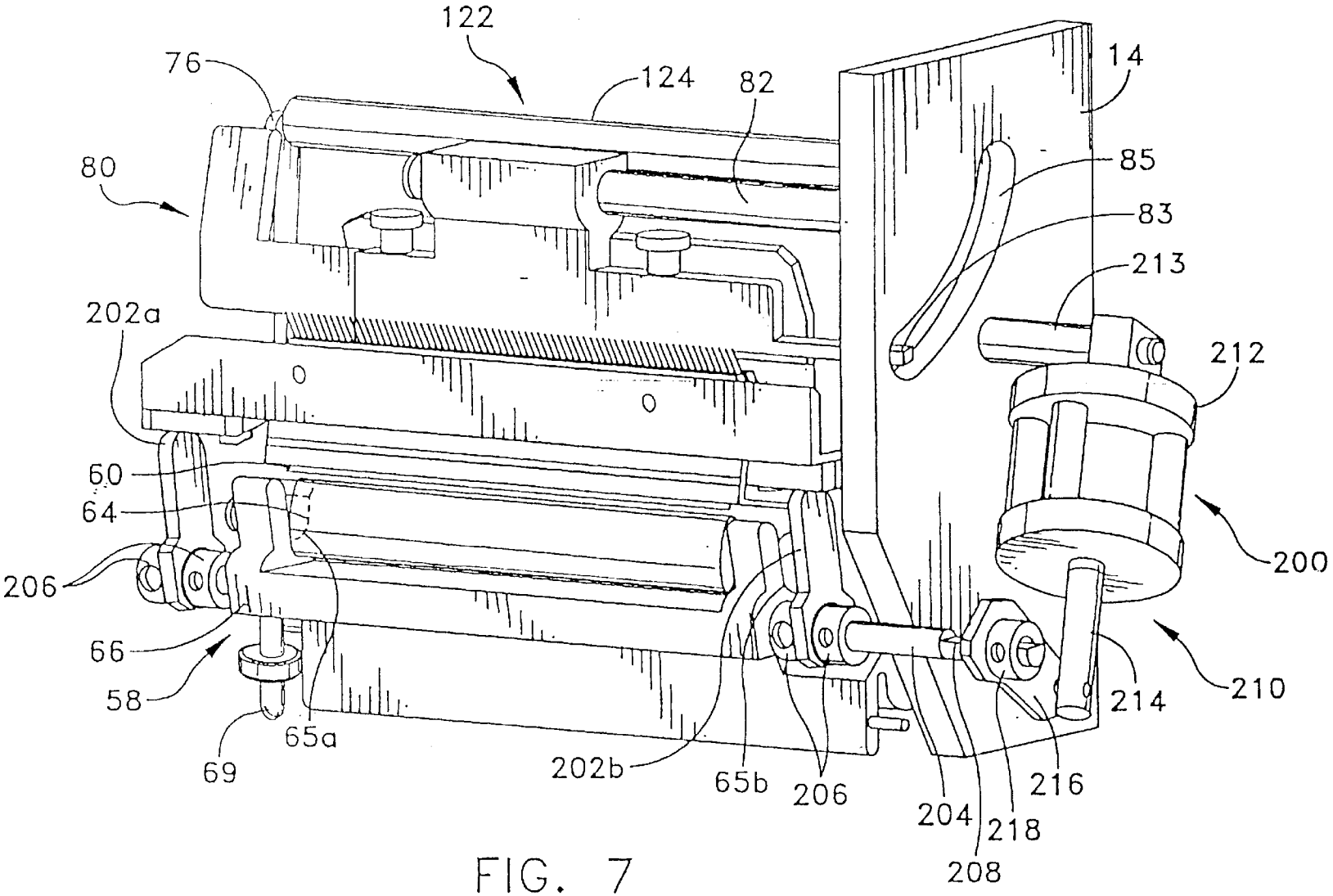
FIG. 7 is a rear perspective view of one printing assembly of the present invention, showing the head being lifted out of engagement with the platen.

The printing assemblies 16, 18, 20 and 22 will now be described in greater detail. Since all four printing assemblies are identical, only printing assembly 16, separately shown in FIGS. 4–7, will be described. FIGS. 4 and 5 are side views which show the printing assembly 16 without the back plate 14, while FIGS. 6 and 7 are front and rear perspective views of the printing assembly 16 showing a portion of the back plate 14 as it is attached to the printing assembly 16. Printing assembly 16 comprises an adjustable platen assembly generally indicated at 58, a thermal print head 60 and a thermal print head mounting assembly 62. The platen assembly 58 comprises a cylindrical platen 64 comprising a rubberized outer shell 64*a* and an axle 64*b* and a platen mounting bracket 66 which is mounted to the back plate 14 and is operative for rotatably receiving the platen 64 within a U-shaped outboard slot 65*a* and a U-shaped inboard slot 65*b*. The platen 64 is adjustably maintained in parallel relation to the print head 60 by a jackscrew 67, which is threaded into an aperture 69, shown in phantom in FIG. 4, in platen mounting bracket 66. Aperture 69 opens into the bottom of slot 65*a* to allow jackscrew 67 to adjust the position of axle 64*a* within outboard slot 65*a*. In order to maintain the platen 64 in a parallel relationship with the print head 60, the jackscrew 67 is rotated to either raise or lower the outboard end of the platen 64 through contact with the axle 64*b*. Since the inboard end of the platen 64 is mounted in the inboard slot 65*b*, as the jack screw is rotated, the outboard end of platen 64 pivots in a vertical plane from the inboard slot 65*b* in order to level the platen so that it is parallel to the print head 60. Once the platen 64 is positioned parallel to the print head 60, it is locked in place by means of a locking device such as a lock nut which may be tightened against the bottom of the platen mounting bracket 66. This adjustability of the platen 64 is advantageous because, if the platen is not precisely parallel to the print head 60 during the printing process, the printing film will wrinkle as it passes between the print head 60 and the platen 64, causing deformities in the printed image, such as voids, streaks and smudging. The adjustable platen assembly 58 allows the placement of the platen 64 to be fine-tuned in order to eliminate wrinkling of the printing film as it passes through the printing assembly.

The print head 60 preferably comprises a conventional thermal print head having an array of discretely energizable thermal elements. Energizing of the thermal elements is controlled by the controller 44 through conventional cable means (not shown).

The print head mounting assembly 62 is operative for mounting the print head 60 in substantially parallel relation to the platen 64 so that it is moveable between a media-loading position, shown by second printing assembly 18 in FIG. 3, where the print head 60 is lifted out of engagement with the platen 64, and an actuated position, shown by all print assemblies in FIG. 2, where the print head 60 is positioned in biased engagement with the platen 64. The print head mounting assembly 62 comprises a mounting bar indicated at 68 and a pivot bar 70, which is mounted to back wall 14. Mounting bar 68 includes an arm portion 74, which receives the print head 60 at the terminal end thereof. Mounting bar 68 also includes a pair of flanges 72 (only one of which is shown in the figures) having a hole 72*a* through which pivot bar 70 is mounted, between bracket 76 and back wall 14. Mounting bar 68 is mounted on pivot bar 70 to enable the print head mounting assembly 62 to be pivoted between the actuated position and the media-loading position, as will be described in greater detail below. The print head mounting assembly further comprises a pivotable toggle element generally indicated at 80 for maintaining the print head 60 in biased engagement with the platen 64. The toggle element 80 is pivotally mounted to the back plate 14 on a pin 82 at one end thereof, while the opposite end is pivotally movable into engagement with the terminal end of the arm portion 74 of the mounting bar 68. Movement of the toggle element 80 is guided by pin 83, which rides within arcuate slot 85 in back plate 14. More specifically, the toggle element 80 includes a spring mechanism 84 (broken lines), which engages the upper surface of the mounting bar 68. In this regard, the spring mechanism 84 urges the print head mounting assembly 62 downwardly into biased engagement with the platen 64. The terminal end of the mounting bar 68 includes a flange 86 for limiting forward movement of the toggle element 80, as shown by printing assembly 18 in FIG. 3.

Referring now to FIGS. 4 and 5, which show printing assembly 16 with the back plate 14 removed, and FIGS. 6 and 7, which are front and rear perspective views of printing assembly 16, the printing assembly 16 will be described in greater detail. Printing assembly 16 further includes a head lifting apparatus generally indicated at 200, which is mounted to platen assembly 58. Head lifting apparatus 200 comprises a pair of head lifting devices 202*a* and 202*b* which are mounted on a shaft 204 which passes through mounting bracket 66 such that head lifting devices 202*a* and 202*b* are disposed on opposite sides of the mounting bracket 66 and are held in place by a number of locknuts 206. Shaft 204 includes a flat surface 208 at either end thereof. Head lifting apparatus 200 also includes a piston mechanism 210, which includes a piston 212 which is mounted to the back side of back wall 14 by a pin 213 and which drives a rod 214. Rod 214 is pivotally mounted to a lever 216 having a hole 217 through which shaft 204 extends. The hole 217 of lever 216 has the same shape as the cross-sectional shape of shaft 204. In other words, the hole of lever 216 is mostly circular and has a flat edge, which coincides with the flat edge 208 of shaft 204. This allows lever 216 to turn shaft 204 when the piston assembly 200 is activated, as will be described in greater detail below. Lever 216 is held in place on shaft 204 by a lock nut 218.

Referring back to FIG. 2, the feed assembly 32 is operative for advancing the web 12 through the apparatus 10 so that it passes through the first, second, third and fourth printing stations 24, 26, 28 and 30. More specifically, the feed assembly 32 comprises a drive assembly 98, a pressure roller 100 and a toggle element 102 for urging the pressure roller 100 into pressured engagement with the drive roller assembly 98. The drive assembly comprises a drive roller 104 having a rubberized outer shell and a mounting bracket 106 for mounting the drive roller to back plate 14. The pressure roller 100 includes a rubberized outer shell and is rotatably mounted in a bracket 108, which is pivotally mounted to back plate 14 by a pivot pin 110. The toggle element 102 is essentially identical to the previously described toggle elements 80 and it is pivotally moveable for urging the pressure roller 100 into biased engagement with the drive roller 104 so that when the drive roller 104 is rotated, the rollers 100 and 104 cooperate for advancing the web 12 through the apparatus 10.

The stepping motor 34 is drivingly coupled to the drive roller 104 via a drive belt and pulley arrangement (not shown). The stepping motor 34 is operative at a uniform rate of stepped rotational increments per revolution in order to insure precise longitudinal orientation of the different images applied to the labels on web 12 at the printing stations 24, 26, 28 and 30.

The first, second, third and fourth printing film drive assemblies 36, 38, 40 and 42 are operative for advancing their respective printing films 46, 48, 50 and 52 through the respective printing stations 24, 26, 28 and 30 so that the printing films pass between the respective print head 60 and the web 12. The printing films 46, 48, 50 and 52 comprise conventional thin polyester films having heat sensitive coating thereon, and they are responsive to heat from the thermal print heads 60 for transferring selected portions of the coatings thereon onto the labels on the web 12 to apply images or indicia to the labels. In the preferred embodiment each of the printing films 46, 48, 50 and 52 have a different color coating thereon, thereby enabling apparatus 10 to print in multiple colors. The printing films each preferably have a width of approximately 1 to 5 inches. The film drive assemblies 36, 38, 40 and 42 each comprise a film supply hub 118 containing a supply of film and a film take-up hub 120 and several guide rolls 121 and guide mechanisms, generally indicated at 122, for guiding the film into proper alignment into the printing station. Each guide mechanism 122 includes a pair of rollers 124 mounted between bracket 76 and back wall 14. The supply hubs 118 are rotatably mounted to the back plate 14 and include a resistance mechanism (not shown) for applying a slight resistance to rotation of the hub 118 to maintain the films in substantially taut condition as they are passed through the respective print station. The take-up hubs 120 are each rotatably mounted to back plate 14 and are drivingly coupled to drive motors (not shown) through a conventional gear pair (not shown). During operation of apparatus 10, the drive motors are operated in a stall condition to rotate the take-up hubs 120 in order to advance the films through the printing stations, while allowing the take-up hubs 120 to take up any slack in the films as the wound diameters of the take up hubs 120 are increased in order to maintain substantially constant film speeds throughout the printing processes.

The controller 44 is operable in a conventional manner and includes a programmable microprocessor which can be programmed for control of the stepping motor 34, thermal print heads 60, the printing film drive assemblies 36, 38, 40 and 42, the head lifting apparatus 200. More specifically, the controller 44 is programmed so that it is responsive to a predetermined number of stepped rotational increments of the stepping motor 34 for coordinating the energization of the print heads 60 in the printing assemblies 16, 18, 20 and 22. The controller 44 actuates the printing assembly 16 to apply a first image in a first color to a label on the web 12 at the first printing station 24. While the printing assembly 16 is printing on the web 12, the printing head 60 is in the actuated position, shown in FIG. 5, where the print head 60 is positioned in biased engagement with the platen 64. This enables the print head to transfer the colored coating from the printing film onto the web 12. In this position, piston 212 is actuated, causing rod 214 of piston 212 to extend outwardly from piston 212. This causes lever 216 to rotate shaft 204 and head lifting devices 202*a* and 202*b* in a counterclockwise direction, causing head lifting devices 202*a* and 202*b* to controllably release printing head 60 into contact with the platen 64 due to the biasing force applied by spring mechanism 84. Since the spring mechanism 84 applies a constant, consistent biasing force to urge printing head 62 into engagement with platen 64, the printing head does not cause the printed label to be blurred or smudged. Controller 44 then actuates the head lifting apparatus 200 to lift the printing head 60 upwardly out of engagement with the platen 64, as shown in FIGS. 4, 6 and 7. This is done by deactivating the piston 212, causing rod 214 to be retracted into piston 212. This causes lever 216 to rotate shaft 204 and head lifting devices 202*a* and 202*b* clockwise. As head lifting devices 202*a* and 202*b* turn, they contact printing head mounting assembly 62 and lift printing head 60 out of engagement with the platen 64 against the bias force exerted by spring mechanism 84, as shown in FIGS. 4, 6 and 7. Once print head 60 has been lifted out of engagement with the platen 64, controller 44 stops the movement of the printing film drive assembly 36 in order to conserve the print film by advancing it through the printing assembly 16 only while the print assembly 16 is actually printing on the web 12. When it is necessary for printing assembly 16 to print, the print head 60 is returned to the actuated position, as described above, and the controller 44 resumes the advancement of printing film by printing film drive assembly 36. The printing assemblies 38, 40 and 42 are operated in the identical manner described above with reference to printing assembly 36.

FIG. 3 illustrates the apparatus 10 in each of its possible configurations. Printing assembly 16 is shown with the toggle element 80 removed and the head mounting assembly 62 rotated upward to allow access to the printing head 60 for cleaning. Printing assembly 18 is shown in the media loading position, with toggle element 80 pivoted away from the platen 64 to enable head mounting assembly 62 to be lifted away from the platen. This allows the printing film 48 and the web (not shown) to be loaded into printing assembly 18. Printing assembly 20 is shown in the nonactuated position, in which head lifting apparatus 200 maintains the printing head 60 out of engagement with the platen 64. Printing assembly 22 is shown in the actuated position, where head-lifting apparatus 200 has released printing head 60 and spring mechanism 84 biases print head 60 into engagement with the platen 64.

Figure 8:
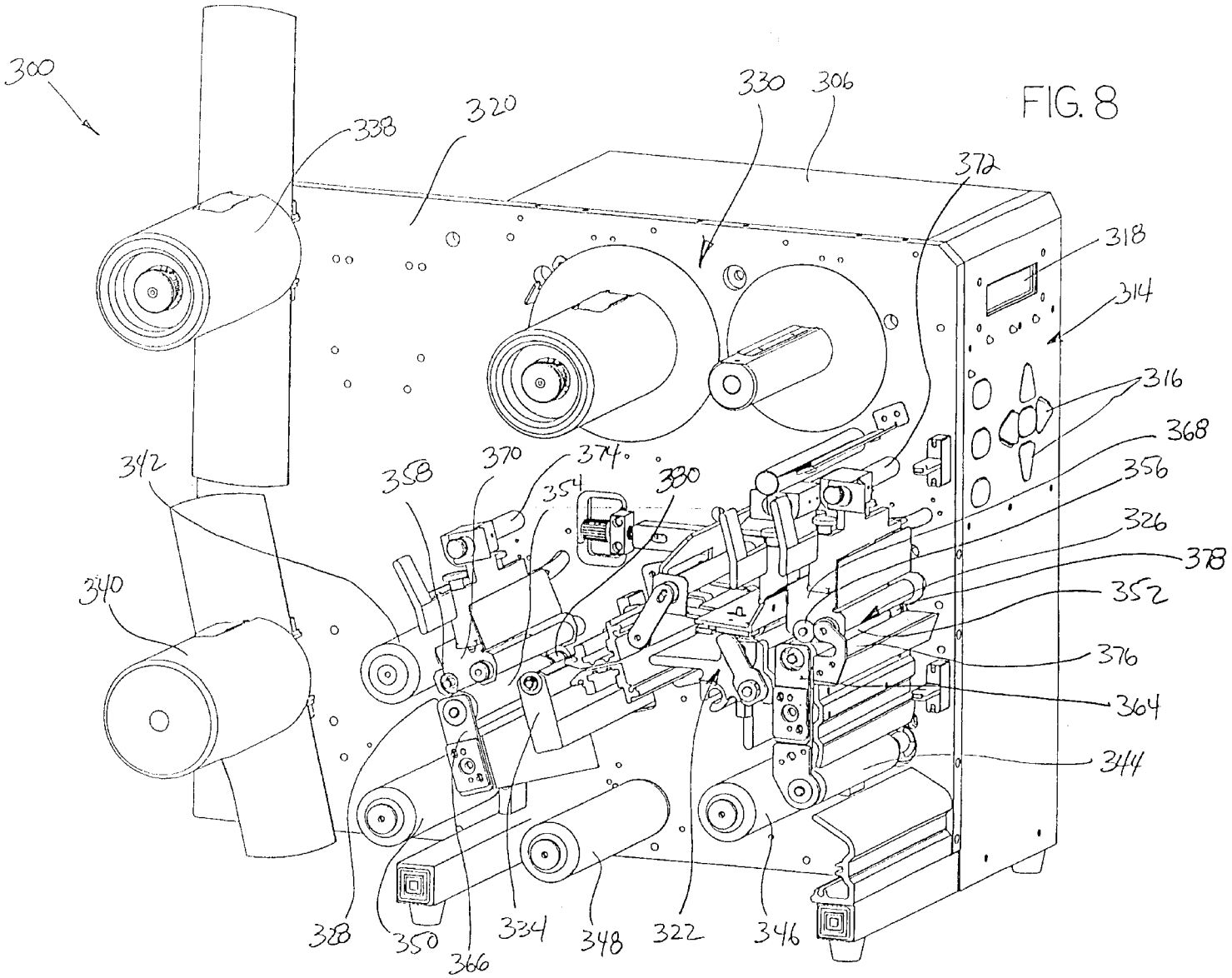
FIG. 8 is a perspective view of a second embodiment of a thermal transfer label printer in accordance with the teachings of the present invention.
Figure 9:
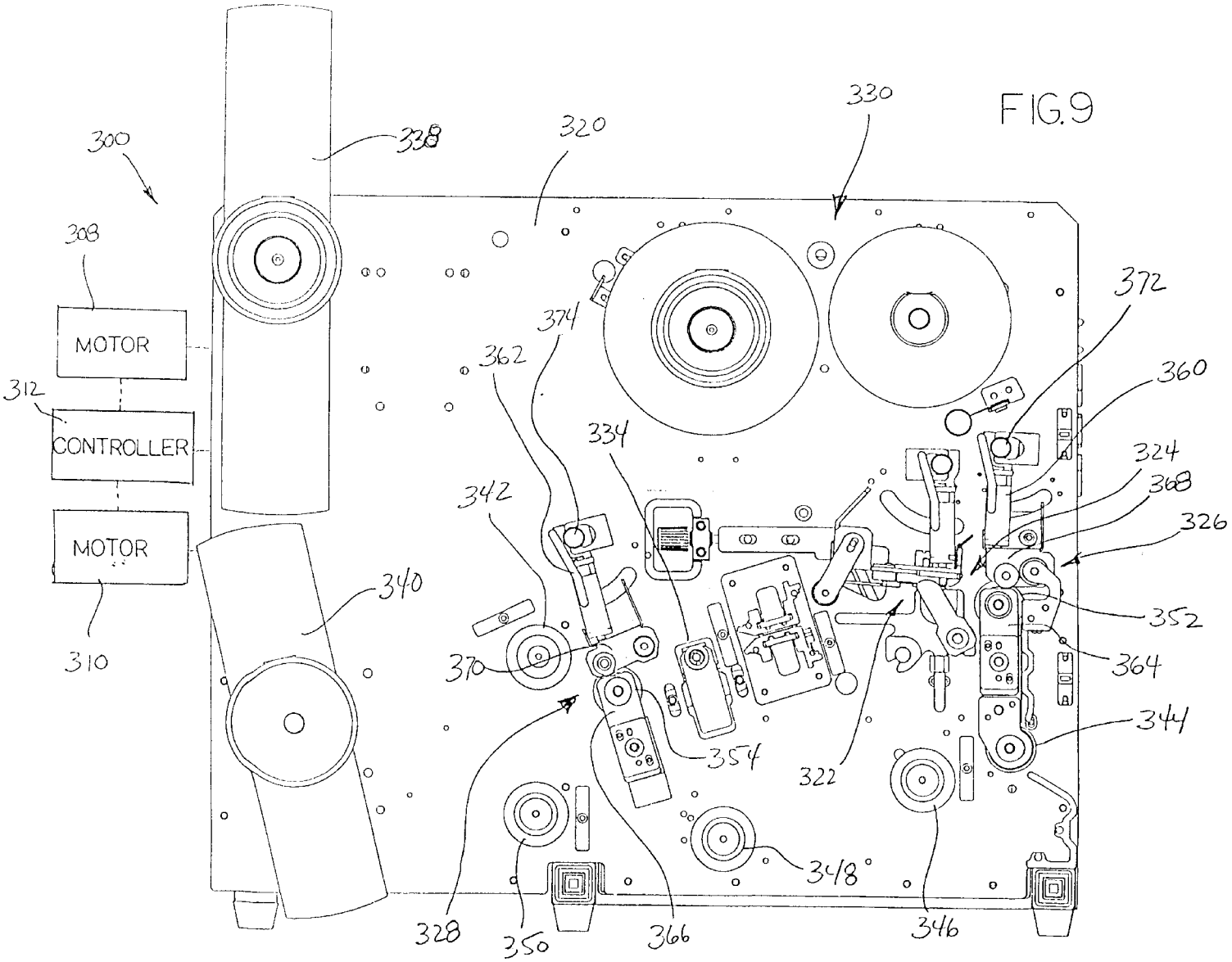
FIG. 9 is a front view thereof.

Referring now to FIGS. 8–11 a second embodiment of a printing assembly incorporating features of the present invention is illustrated and generally indicated at 300. The printing assembly 300 comprises a monochrome thermal transfer label printer having only a single printing station generally indicated at 302. The printing assembly 300 is shown removed from its outer cover housing in FIGS. 8–11. FIG. 8 is a perspective view of the printing device 300 that is capable of printing a single monochrome color on printed articles that are serially connected together or mounted on a carrier media web 12. For purposes of further discussion, the printed articles on which the present invention will be described as printing are adhesive labels 302 which are serially mounted on a carrier web 304. However, it will be understood that any type of suitable article may be printed on using the printing apparatus of the present invention. Printing assembly 300 includes a housing 306 for enclosing certain mechanical devices associated with the device 300, including a stepping motors 308, 310 and a controller 312 (both shown schematically in FIG. 9) for controlling the operation of the printing device 300. The controller 312 includes electronics known in the art and therefore, they will not be described. Housing 306 includes a control panel 314 including a number of control buttons 316 for programming and controlling the printing device 300, as well as a display unit 318 for indicating an operation mode and/or status of the printing device 300.

The apparatus 300 includes a back plate generally indicated at 320 and a single printing assembly generally indicated at 322 operable at a printing station 324 for printing a single color onto each label 302 of the web 304. The printer 300 also includes a first drive assembly generally indicated at 326 for drawing or pulling the web 304 forwardly through the printing station 324, and a second drive assembly generally indicated at 328 for drawing or pulling the web backwardly (retracting) through the printing station 324.

The printer 300 further includes a printing film drive assembly generally indicated at 330. During the operation of the printer 300, the printing film drive 330 is operated to supply a printing film 332 to printing station 324 and the stepping motors 308, 310 are operated to advance and retract the strip 304 in a substantially taut disposition through the printing station 324. The controller 312 is responsive to a predetermined number of increments of an encoder 334, which tracks the position and speed of the labels 302 on the web 304, for controlling the printing assembly 322 to apply an image to the labels 302 mounted on web 304 so that the longitudinal positions of the images are precisely coordinated throughout the length of each label 302 and the length of the web 304.

Figure 10:
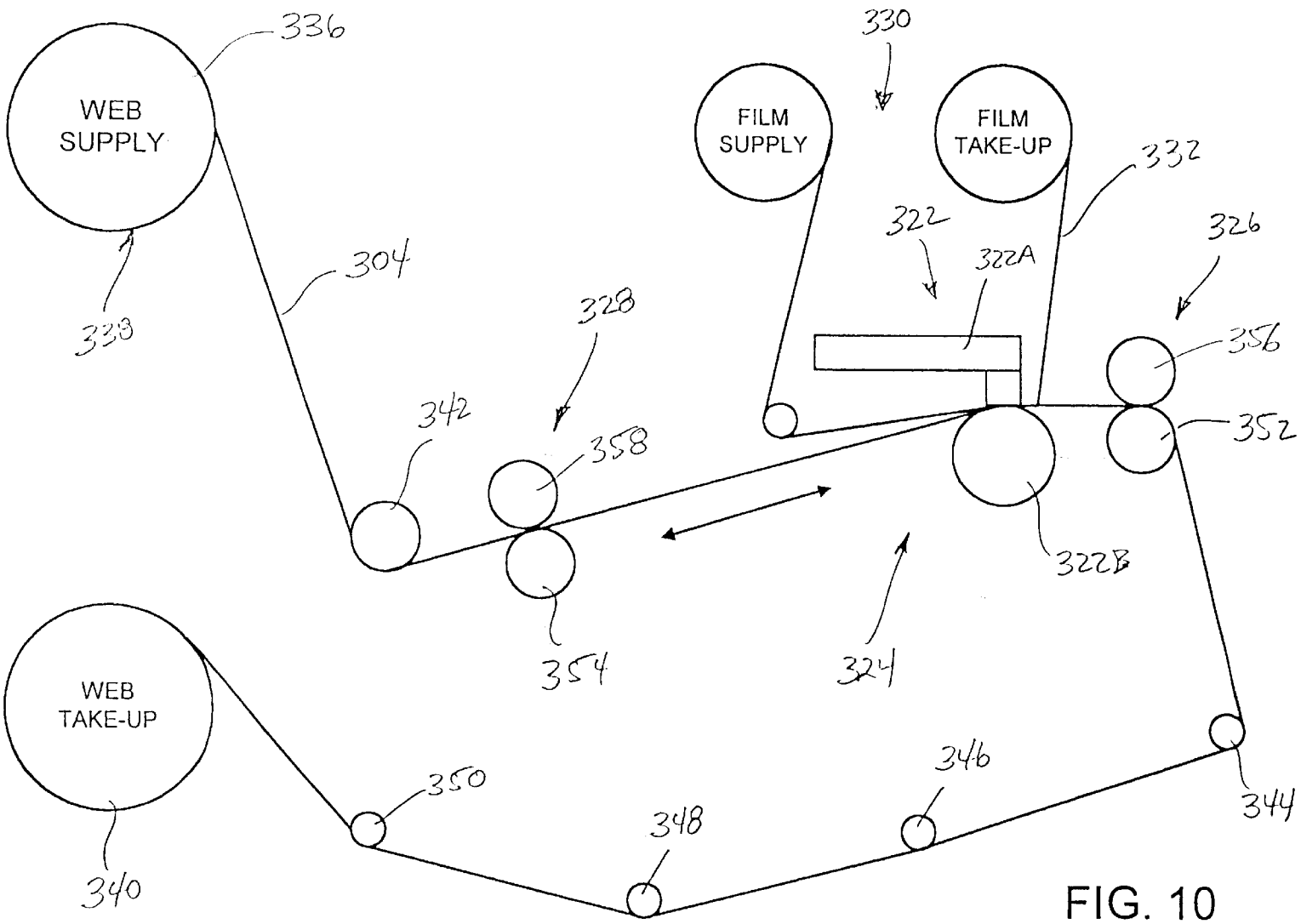
FIG. 10 is a schematic view showing movement of the print media through the advancing and pull-back drives.

The web 304, as described above, preferably comprises a continuous strip of a plastic or paper-like substrate having a number of adhesive-backed labels 302 serially mounted thereon. While, in this description, the labels 302 preferably have an adhesive backing for mounting to the web 304 and then to a product after printing, it will be understood that the labels may be mounted to the web by other known means. The web 304 is preferably provided in a continuous roll 336 which is mounted on payoff roller 338 mounted to the back plate 320, and subsequently wound onto a take-up roller 340 also mounted to the back plate. The payoff roller 338 includes a back-tension clutch to prevent print media slack and to maintain print media taughtness. Referring to FIG. 10, the path of the web 304 travels from the payoff roller 338 around idle roller 342 through drive assembly 328, through encoder 334, through the printing assembly 322, through drive assembly 326, and around idle rollers 344, 346, 348, 350, ultimately ending on the take-up roller 340.

The printing assembly 322 is identical to the printing assemblies 14, 16, 18 20 as described hereinabove and is operative in the same manner as those previously described for both printing and lifting and lowering the print head during operation of the printer. In this regard, the printing assembly includes a print head 322A and a printing platen 322B, which will be referred to hereinafter. Still referring to FIGS. 8–11, the first drive assembly 326 is operative for advancing, i.e. pulling the web 304 through the printer so that it passes forwardly through the printing station 324, while the second drive assembly 328 is operative for retracting, i.e. pulling, the web 304 so that it passes backwardly through the printing station 324. More specifically, each drive assembly 326, 328 comprises a drive roller 352, 354 respectively, a pressure roller 356, 358 respectively and a toggle element 360, 362 for urging the pressure roller 356, 358 into pressured engagement with the drive roller 352, 354. The drive rollers 352, 354 are mounted on mounting brackets 364, 366. The pressure rollers 356, 358 are rotatably mounted in brackets 368, 370, which are pivotally mounted to back plate 320 by pivot pins 372, 374. The toggle elements 360, 362 are essentially identical to the previously described toggle elements and they are pivotally moveable for urging the pressure rollers 356, 358 into biased engagement with the drive rollers 352, 354.

The stepping motors 308, 310 are drivingly coupled to the drive rollers 352, 354 via drive belt and pulley arrangements (not shown). The stepping motors 308, 310 are operative at a uniform rate of stepped rotational increments per revolution in order to insure precise longitudinal orientation of the different images applied to the labels 302 on web 304 at the printing station 324.

The printing film drive assembly 330 is operative for advancing the printing film 332 through the printing station 324 so that the printing film passes between the print head 322A and the web 304. The printing film 332 comprises conventional thin polyester film having a heat sensitive coating thereon, and it is responsive to heat from the thermal print head 322A for transferring selected portions of the coating thereon onto the labels 302 on the web 304 to apply images or indicia to the labels. In the present embodiment 300, the printing film 332 has a single color coating thereon, thereby enabling apparatus 300 to print a single monochrome color. The printing film drive assembly 330 is identical in structure and operation to those printing film drive assemblies as described hereinabove.

Figure 11:
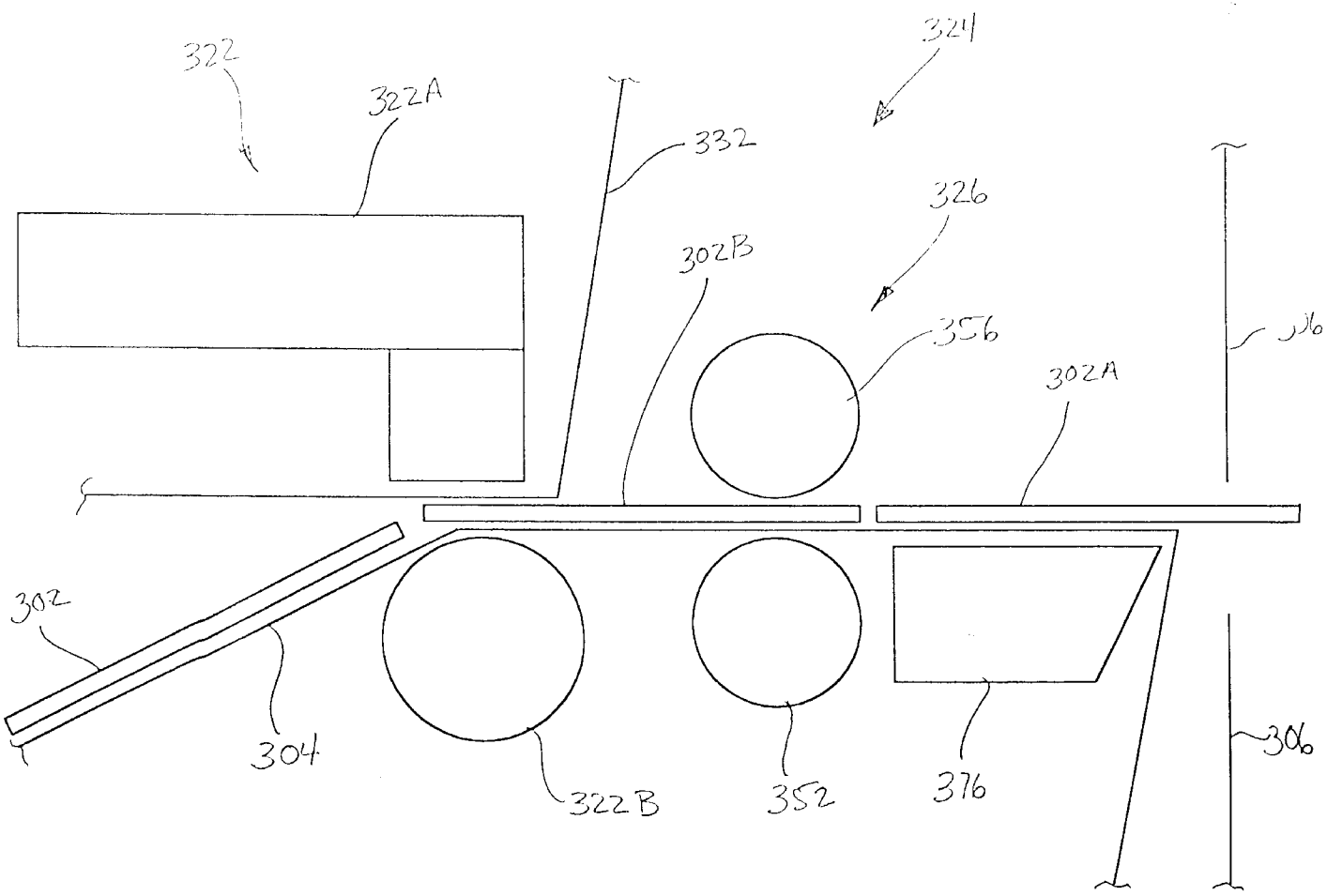
FIG. 11 is an enlarged schematic view of the print station showing movement of the individual labels through the print station.

The controller 312 is operable in a conventional manner and includes a programmable microprocessor which can be programmed for control of the stepping motors 308, 310, thermal print head 322A, the printing film drive assembly 330, and the print head lifting apparatus. More specifically, the controller 312 is programmed so that it is responsive to the encoder 334 and to a predetermined number of stepped rotational increments of the stepping motors 308, 310 for coordinating the energization of the print head 322A. Once the first label 302A is properly positioned in the print station 324, the controller 312 energizes the print head 322A and the first drive assembly 328 to apply a colored image to label 302A on the web 304. While the print head 322A is being actively energized, the first drive assembly 326 pulls the web 304 forwardly through the print station 324 to apply the image to the label 302A. While the printing assembly 322 is printing on the web 304, the print head 322A is in the actuated position, as shown in FIG. 5 of the first embodiment, where the print head 322A is positioned in biased engagement with the platen 322B. This enables the print head 322A to transfer the colored coating from the printing film 332 onto the web 304. After the image is applied to the first label 302A, the controller 312 then actuates the head lifting apparatus to lift the print head 322A upwardly out of engagement with the platen 322B. Once print head 322A has been lifted out of engagement with the platen 322B, controller 312 stops the movement of the printing film drive assembly 330 in order to conserve printing film 332, but continues to operate the first drive assembly 326 to advance the web 304 to the position as shown in FIG. 11, so that the just printed label 302A is advanced through the first drive assembly 326 and outwardly of the housing for presentation to the operator of the printer 300. It can be seen in FIG. 11, that the label 302A is automatically peeled off of the backing web 304 and pushed through the exit in the housing. This is accomplished by passing the web 304 downwardly over a guide 376 and around the idle rollers 342–350. The operator can then easily remove the printed label 302A from the web 304. Once the controller 312 senses that the label 302A has been removed, the controller 312 can then operate the second drive assembly 328 to pull the web 304 backwardly through the print station to align the next label 302B for printing. The next label 302B can then be printed in the same manner as the first label 302B without waste of the printing film 332 or labels 302.

In order to achieve the dual direction of driving movement of the web 304, it is noted that each of the drive rollers 352, 354 is rotatably mounted and driven by means of a one-way clutch 378, 380 (See FIG. 8). In this manner, when the drive roller 352 of the first drive 326 is operative for pulling the web 304 in a forward direction (clockwise rotation), the drive roller 354 of the second drive 328 is operative for frictional spinning in the clockwise direction, and vice versa, when the drive roller 354 of the second drive 328 is operative for pulling the web 304 in a backward direction (counter clockwise rotation), the drive roller 352 of the first drive 326 is operative for frictional spinning in the counter clockwise direction. It is noted that the clutches 378 maintain a certain level of back tension on the web so that the web remains taught during both advancing of the web and during printing. Maintaining taughtness of the web reduces printing registration problems and printing errors.

It can be therefore seen that the instant invention provides a novel and effective apparatus 10 for printing multiple colors to labels on a web 12, while conserving the printing film by advancing the film through a particular printing apparatus only when that printing apparatus is to print on the label. The apparatus 10 includes four printing assemblies 16, 18, 20 and 22 that are individually operable for applying an image to the surface of a label on the web 12. Each printing assembly is movable between an actuated position in which the printing head is engaged with the platen 64 and a non-actuated position, in which the printing head 60 is lifted out of engagement with the platen 64. A head lifting apparatus 200 associated with each printing assembly is activated to lift the print head to the non-actuated position and to release the print head into the activated position. When a particular printing assembly is to print on a label on the web 12, it is released by the associated head lifting apparatus into biased engagement with the platen 64 and printing film is advanced across the print head to enable the transfer of ink onto the label from the printing film. When the printing assembly completes printing on the label, the head lifting apparatus lifts the head out of engagement with the platen and the advancement of the printing film is ceased. In this way, the printing film is only advanced through the printing assembly when the printing assembly is actually printing on a label, thereby greatly conserving the printing film. It can further be seen that the printing apparatus 300 provides a novel and effective apparatus for instant printing of labels. The printer effectively prints individual labels on a carrier web, and immediately presents the just printed label for use without wasting other labels on the web, or wasting the printing film or disproportionately spacing the labels on the web.

While there is shown and described herein certain specific structure embodying the invention, it will be manifest to those skilled in the art that various modifications and rearrangements of the parts may be made without departing from the spirit and scope of the underlying inventive concept. For example, while, in the preferred embodiment, the apparatus 10 includes four printing assemblies, it can include any number of printing assemblies. Furthermore, while the head lifting apparatus 200 is described as being actuated by a piston, it will be understood that other actuation devices, such as direct drive motors and solenoids, could also be used in conjunction with the present invention. Accordingly, the inventive concept is not limited to the particular forms herein shown and described except insofar as indicated by the scope of the appended claims.

What is claimed is:

1. A thermal transfer printing apparatus for applying images to a continuous web of print media, said print media comprising a plurality of labels serially mounted on a continuous backing web, the apparatus comprising:

a printing mechanism having a platen and a thermal print head mounted for biased engagement with said platen, said print media passing intermediate said thermal print head and said platen;

a print head lifting mechanism selectively engageable with said print head for moving said print head between a first position wherein said print head is biased into engagement with said platen, and a second position wherein said print head is lifted out of engagement with said platen;

a feed drive positioned forwardly of said printing mechanism for pulling said continuous web forwardly through said printing mechanism; and a tensioning device positioned rearwardly of said printing mechanism for maintaining said continuous web in a taught condition, wherein said tensioning device comprises a rearward feed drive positioned rearwardly of said printing mechanism for pulling said continuous web rearwardly through said printing mechanism said feed drive cooperating with said tensioning device to maintain said continuous web in a taught position for printing and to facilitate smooth release of said print head from said print media during lifting of the print head.

2. The thermal transfer printing apparatus of claim 1 further comprising:

a thermal printing film passing intermediate the continuous web and the thermal print head, said thermal printing film being wound between a thermal printing film supply roll and a thermal printing film take-up roll.

3. A thermal transfer printing apparatus for applying images to a continuous web of print media, said print media comprising a plurality of labels serially mounted on a continuous backing web, the apparatus comprising:

a supply roll carrying said continuous web of print media;

a take up roll for taking up said backing web as said labels are printed;

a printing mechanism having a platen and a thermal print head mounted for biased engagement with said platen, said print media passing intermediate said thermal print head and said platen;

a thermal printing film passing intermediate the print media and the thermal print head;

a print head lifting mechanism selectively engageable with said print head for moving said print head between a first position wherein said print head is biased into engagement with said platen, and a second position wherein said print head is lifted out of engagement with said platen, said print head being selectively lifted to facilitate conservation of said printing film during periods of non-printing;

a first drive positioned forwardly of said printing mechanism for pulling said continuous web forwardly through said printing mechanism when said print head is in said first position whereby images are printed on said labels, said first drive being further operative for advancing said continuous web forwardly when said print head is in said second position such that said printed label is advanced to an exit station for removal from said backing web; and a second drive positioned rearwardly of said printing mechanism for pulling said continuous web rearwardly through said printing mechanism when said print head is in said second position whereby a next serially mounted label is positioned for printing in said printing mechanism, said first and second drives cooperating to maintain said continuous web in a taught position for printing and to facilitate smooth release of said print head and said thermal printing film from said print media during forward and rearward movement thereof.

4. The thermal transfer printing apparatus of claim 3 wherein said first and second drives each comprise a drive roller and a pressure roller, said respective drive rollers and pressure rollers being rotatably mounted in facing relation for capturing said continuous web in a nip drive relation for driving said web.

5. The thermal transfer printing apparatus of claim 4 wherein said drive rollers are each mounted with a one-way clutch to allow driving rotation in a first direction and frictional rotation in an opposite direction.

6. The thermal transfer printing apparatus of claim 5 wherein said one way clutch on said drive roller of said first web drive allows frictional rotation in a counterclockwise direction, and said one way clutch on said drive roller of said second web drive allows frictional rotation thereof in a clockwise direction.

* * * * *